US011070011B2

(12) United States Patent
Bentz

(10) Patent No.: US 11,070,011 B2
(45) Date of Patent: Jul. 20, 2021

(54) REMOTELY CONFIGURABLE CONNECTOR

(71) Applicant: SMITHS INTERCONNECT AMERICAS, INC., Kansas City, KS (US)

(72) Inventor: Jedidiah Bentz, Jupiter, FL (US)

(73) Assignee: SMITHS INTERCONNECT AMERICAS, INC., Kansas City, KS (US)

( * ) Notice: Subject to any disclaimer, the term of this patent is extended or adjusted under 35 U.S.C. 154(b) by 0 days.

(21) Appl. No.: 16/774,978

(22) Filed: Jan. 28, 2020

(65) Prior Publication Data

US 2020/0303882 A1 Sep. 24, 2020

Related U.S. Application Data

(60) Provisional application No. 62/798,375, filed on Jan. 29, 2019.

(51) Int. Cl.
*H01R 13/70* (2006.01)
*H01R 13/66* (2006.01)

(52) U.S. Cl.
CPC ..... *H01R 13/70* (2013.01); *H01R 13/665* (2013.01)

(58) Field of Classification Search
CPC ..... H01R 24/76; H01R 13/6691; H01R 2103/00; H01R 13/6683; H01R 13/713; H01R 25/003; H01R 25/006; H01R 31/065; H01R 13/7175; H01R 13/514; H01R 13/641; H01R 13/665; H01R 13/72; H01R 29/00; H01R 13/70; H01R 13/703; H01R 2105/00; H01R 33/92; H01R 13/052; H01R 13/6272; H01R 13/6675; H01R 13/73; H01R 2107/00; H01R 24/60; H01R 24/62; H01R 24/68; H01R 25/142; H01R 27/02; H01R 33/00
See application file for complete search history.

(56) References Cited

U.S. PATENT DOCUMENTS 4,689,023 A * 8/1987 Strong, III ..... H01R 29/00 310/71
6,007,346 A * 12/1999 Gutierrez ..... B60D 1/62 439/35
6,244,908 B1 * 6/2001 Hammond ..... H01R 13/7031 200/51.03
6,394,853 B1 * 5/2002 Hammond ..... H01R 13/70 439/676
10,720,740 B1 * 7/2020 Lu ..... H01R 27/00
2009/0251068 A1 * 10/2009 Holec ..... H05B 45/395 315/294
2012/0220148 A1 * 8/2012 Walls, Jr. ..... H01R 31/06 439/218

(Continued)

*Primary Examiner* — Truc T Nguyen
(74) *Attorney, Agent, or Firm* — Snell & Wilmer LLP

(57) ABSTRACT

A reconfigurable connector having a first set of electrical contacts and a second set of electrical contacts each configured to be electrically connected to electronic elements. The reconfigurable connector further includes a network access device configured to receive a signal from a remote device and an internal switch coupled to the network access device and configured to reconfigure pairing of the first set of electrical contacts and the second set of electrical contacts based on the signal received by the network access device.

16 Claims, 2 Drawing Sheets

(56) References Cited

U.S. PATENT DOCUMENTS

| | | | | |
|---|---|---|---|---|
| 2013/0040468 | A1* | 2/2013 | Motomiya | B60R 1/072 439/34 |
| 2014/0120750 | A1* | 5/2014 | Johnson | H01R 27/00 439/131 |
| 2014/0300322 | A1* | 10/2014 | Chien | H02J 7/0042 320/114 |
| 2017/0179650 | A1* | 6/2017 | Spiel | H01R 13/665 |
| 2019/0350065 | A1* | 11/2019 | Stuby, Jr. | H05B 47/115 |
| 2020/0287338 | A1* | 9/2020 | Wang | H01R 13/5213 |

* cited by examiner

REMOTELY CONFIGURABLE CONNECTOR

CROSS REFERENCE TO RELATED APPLICATIONS

This application claims the benefit and priority of U.S. Provisional Application No. 62/798,375 titled "REMOTELY CONFIGURABLE CONNECTOR," filed on Jan. 29, 2019, the entire contents of this application is hereby incorporated by reference herein.

BACKGROUND

1. Field

This disclosure is directed to remotely configurable connectors.

2. Description of the Related Art

Connectors are used in many different environments such as computing, communication systems, various automotive systems, and most environments that include electronics. Such connectors may be used to at least one of transmit or receive data, power, or a combination thereof. Occasionally, it may be required to change the configuration of a connector for various reasons such as to accommodate design changes in a system. Currently, this is performed by either swapping out the connector or reconfiguring the connector in a mechanical way such as removing or manually moving and re-soldering wires within the connector. Thus, there is a need in the art for reconfigurable connectors.

SUMMARY

A reconfigurable connector having a first set of electrical contacts and a second set of electrical contacts each configured to be electrically connected to electronic elements. The reconfigurable connector further includes a network access device configured to receive a signal from a remote device and an internal switch coupled to the network access device and configured to reconfigure pairing of the first set of electrical contacts and the second set of electrical contacts based on the signal received by the network access device.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

It has become clear that there is a customer desire to have smart, reconfigurable connectors. However, this desire is limited by the mechanical means of existing connectors because of size constraints and the fact that adding power to a connector would require either being a parasite on a system or having some other form of power (i.e., a battery).

Figure 1:
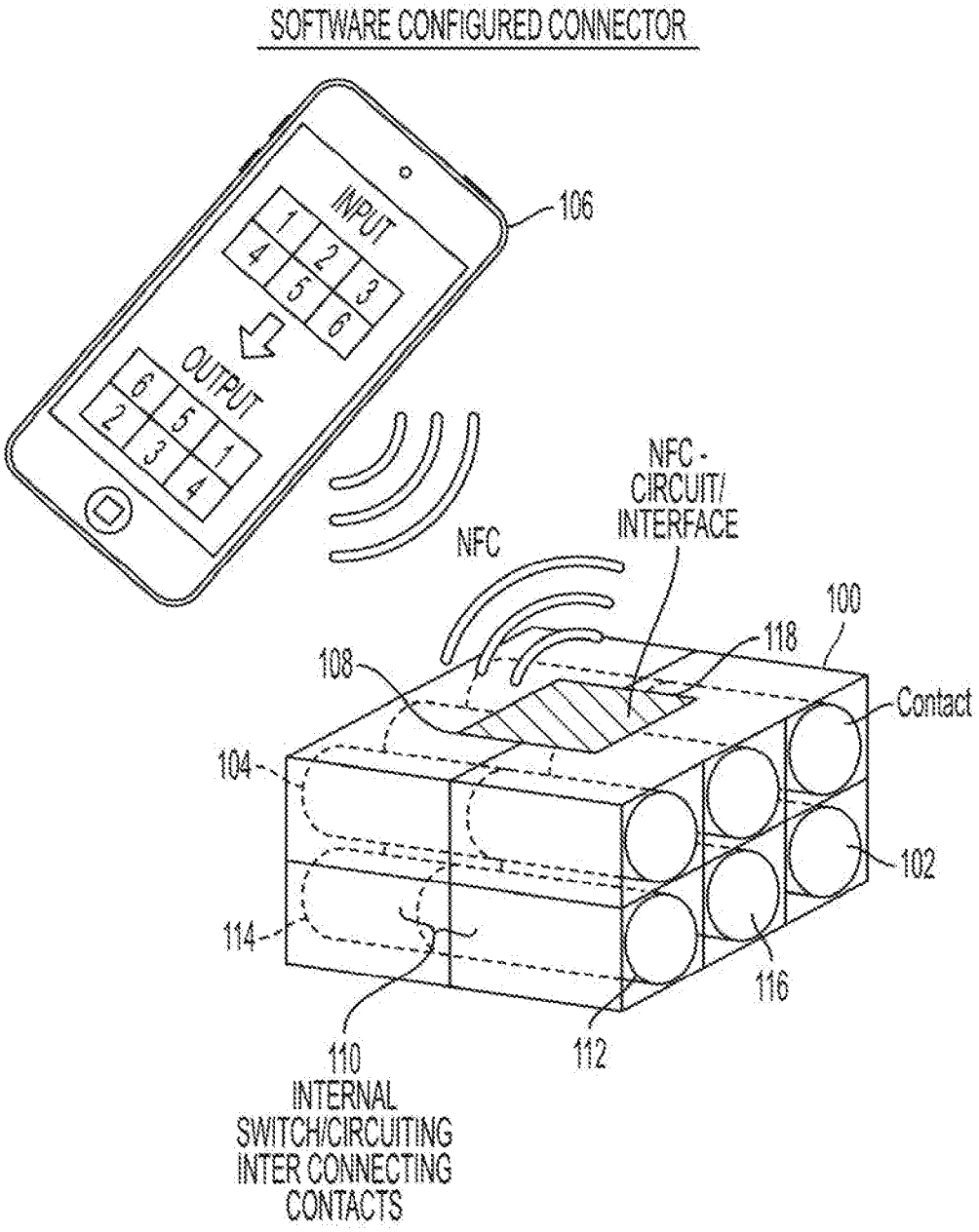
FIG. 1 illustrates an exemplary reconfigurable connector and a remote device for reconfiguring the reconfigurable connector according to an aspect of the invention.

Referring to FIG. 1, an exemplary reconfigurable connector 100 and a remote device 106 for reconfiguring the reconfigurable connector are shown. The reconfigurable connector 100 may be used in various settings to connect two components. For example, the reconfigurable connector 100 may be used to connect an edge card to a printed circuit board (PCB), to connect a PCB to an external device, to connect a vehicle component to an electronic control unit (ECU), or the like.

The reconfigurable connector 100 includes a first set of electrical contacts 102 and a second set of electrical contacts 104. The reconfigurable connector 100 further includes a network access device 108 and an internal switch 110.

The first set of electrical contacts 102 may include any electrical contacts such as one or more wire, cable, socket, pin, touch contact, or the like. The second set of electrical contacts 104 may include any electrical contacts such as one or more wire, cable, socket, pin, touch contact, or the like and may or may not include a complimentary set of contacts relative to the first set of electrical contacts 102.

The network access device 108 may transmit and/or receive data in various manners. For example, the network access device 108 may communicate via one or more wired or wireless protocol such as near field communications (NFC), Bluetooth, Wi-Fi, 3G, 4G, 5G, other cellular protocols, vehicle-to-vehicle (V2V) communications, Zigby, backnet, or the like. The network access device 108 may communicate with the remote device 106 via one or more protocol.

The internal switch 110 may reconfigure connections between the first set of electrical contacts 102 and the second set of electrical contacts 104. For example, the reconfigurable connector 100 may be provided in a configuration where a first electrical contact 112 and a second electrical contact 114 are electrically coupled together. However, it may be desirable to reconfigure the reconfigurable connector 100 such that a third electrical contact 116 is electrically coupled to the second electrical contact 114 in response to design changes, additions to the system, use of the reconfigurable connector 100 in a different setting, or the like. In that regard, a user may utilize the remote device 106 to transmit the new desired configuration to the reconfigurable connector. The remote device 106 may transmit the new configuration to the network access device 108, and the configuration may be transmitted to the internal switch 110 or a controller 118 which may control the internal switch 110 to apply the new configuration.

Use of NFC as the means of communications between the remote device 106 and the network access device 108 may be desirable for a variety of reasons. For example, NFC communications may be desirable due to a lack of power required for the communications on the reconfigurable connector 100. In that regard the signal transmitted by the remote device 106 may include a power signal to power the network access device 108. In some embodiments, the signal transmitted by the remote device 106 may likewise power the controller 118 and the internal switch 110.

The internal switch 110 may reconfigure the connections between the first set of electrical contacts 102 and the second set of electrical contacts 104. The internal switch 110 may include an electrical switch, a motor (for example to move a circulating contact between the first set of electrical contacts 102 and the second set of electrical contacts 104), a set of transistors, a field programmable gate array (FPGA), a controller, a processor, or the like.

Use of the reconfigurable connector 100 provides various benefits and advantages. The reconfigurable connector 100 may be used to change the pairing of inputs and outputs, such as in an environment where there is benefit in the connector 100 being configured quickly and changes made for optimization of systems. For example, the reconfigurable connector 100 may be reconfigured when a system design is changed and a new connector configuration is required, to provide redundancy (e.g., when one contact is broken, the connection of an essential element may be switched to a new contact), to quickly apply a connector to a new design without having to design a new connector, or the like.

Use of the reconfigurable connector 100 allows for a software-based reconfiguration of the connector 100 without requiring a dedicated power source for reconfiguration. Additionally, if proximity to the connector 100 is required for reconfiguration (such as due to use of NFC communications), extra security is provided due to the required proximity. That is, a person must be physically present at the connector 100 to reconfigure it. Additionally, this provides security against data theft from the connector 100.

In some embodiments, the remote device 106 may be connected electronically to one or more of the first set of electrical contacts 102 or the second set of electrical contacts 104. In that regard, the remote device 106 may transmit the new configuration to the reconfigurable connector 100 via its connection to the first set of electrical contacts 102 or the second set of electrical contacts 104. In that regard, the network access device 108 may be unnecessary.

In some embodiments, the function of the network access device 108 and the controller 118 may be implemented in the same component, such as a computer chip. In some embodiments, the network access device 108 and the controller 118 may be separate components.

Figure 2C:
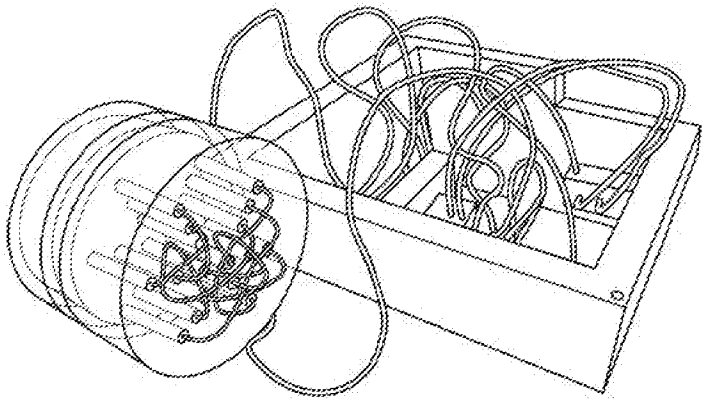
FIG. 2 illustrates a reconfigurable connector that includes a mechanical motor that rotates, changing the pairing of a first set of electrical contacts and a second set of electrical contacts according to an aspect of the invention.
Figure 2B:
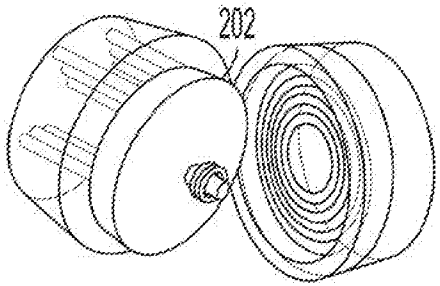
Figure 2A:
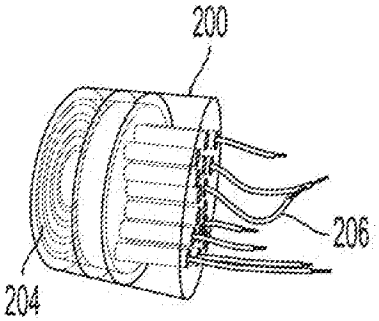

FIG. 2 illustrates a reconfigurable connector 200 that includes a mechanical motor 202 that rotates, changing the pairing of a first set of electrical contacts 204 and a second set of electrical contacts 206. As a network access device 208 receives a signal corresponding to a new configuration of the connector 200, the motor 202 rotates to achieve the desired configuration.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A reconfigurable connector, comprising:

a first set of electrical contacts and a second set of electrical contacts each configured to be electrically connected to electronic elements;

a network access device configured to receive a signal from a remote device; and an internal switch coupled to the network access device and including a motor configured to physically reconfigure pairing of the first set of electrical contacts and the second set of electrical contacts based on the signal received by the network access device.

2. The reconfigurable connector of claim 1 wherein the network access device includes a near field communications (NFC) compatible network access device configured to receive the signal via NFC.

3. The reconfigurable connector of claim 1 further comprising a controller coupled to the network access device and the internal switch and configured to control the internal switch based on the signal received by the network access device.

4. The reconfigurable connector of claim 1 wherein the network access device is further configured to receive a power signal from the remote device to power the network access device.

5. The reconfigurable connector of claim 4 wherein the power signal received by the network access device is further used to power the internal switch.

6. The reconfigurable connector of claim 1 wherein the internal switch is configured to physically reconfigure the pairing while the first set of electrical contacts and the second set of electrical contacts each remain electrically connected to the electronic elements.

7. A reconfigurable connector, comprising:

a first set of electrical contacts and a second set of electrical contacts each configured to be electrically connected to electronic elements; and an internal switch coupled to the first set of electrical contacts and the second set of electrical contacts and configured to receive a signal from a remote device via at least one of the first set of electrical contacts or the second set of electrical contacts, the internal switch including a motor configured to physically reconfigure pairing of the first set of electrical contacts and the second set of electrical contacts based on the received signal.

8. The reconfigurable connector of claim 7 further comprising a controller coupled to the internal switch and configured to control the internal switch based on the received signal.

9. The reconfigurable connector of claim 7 wherein the internal switch is further configured to receive a power signal from the remote device to power the internal switch.

10. The reconfigurable connector of claim 7 wherein the internal switch is configured to physically reconfigure the pairing while the first set of electrical contacts and the second set of electrical contacts each remain electrically connected to the electronic elements.

11. A connector, comprising:

first electrical contacts and second electrical contacts each configured to be electrically coupled to components;

a network access device configured to receive a signal from a remote device; and a motor coupled to the network access device and configured to physically reconfigure a pairing between the first electrical contacts and the second electrical contacts based on the signal received by the network access device.

12. The connector of claim 11 wherein the network access device includes a near field communications (NFC) compatible network access device configured to receive the signal via NFC.

13. The connector of claim 11 further comprising a controller coupled to the network access device and the motor and configured to control the motorbased on the signal received by the network access device.

14. The connector of claim 11 wherein the network access device is further configured to receive a power signal from the remote device to power the network access device.

15. The connector of claim 14 wherein the power signal received by the network access device is further used to power the motor.

16. The connector of claim 11 wherein the motor is configured to physically reconfigure the pairing while the first electrical contacts and the second electrical contacts each remain electrically connected to the components.

* * * * *